US008091296B2

(12) United States Patent
Horn

(10) Patent No.: US 8,091,296 B2
(45) Date of Patent: Jan. 10, 2012

(54) STORM COLLAR APPARATUS AND METHOD OF INSTALLATION

(75) Inventor: Michael William Horn, Kitchener (CA)

(73) Assignee: Toyota Motor Engineering & Manufacturing North America (TEMA), Erlanger, KY (US)

( * ) Notice: Subject to any disclaimer, the term of this patent is extended or adjusted under 35 U.S.C. 154(b) by 2 days.

(21) Appl. No.: 12/697,587

(22) Filed: Feb. 1, 2010

(65) Prior Publication Data

US 2011/0185676 A1 Aug. 4, 2011

(51) Int. Cl.
*E04B 7/00* (2006.01)
*E04H 12/28* (2006.01)
*E04H 12/00* (2006.01)

(52) U.S. Cl. ..... 52/198; 52/199; 52/219; 52/244; 52/101; 52/300

(58) Field of Classification Search ..... 52/198, 52/199, 219, 244, 101, 300, 301, 218; 454/365; 138/112–114, 96 R, 285
See application file for complete search history.

(56) References Cited

U.S. PATENT DOCUMENTS

| | | | | | |
|---|---|---|---|---|---|
| 1,103,666 | A | | 7/1914 | Fife | |
| 1,442,172 | A | | 1/1923 | Nelson | |
| 1,686,881 | A | | 10/1928 | Stephenson | |
| 3,105,664 | A | * | 10/1963 | Poradum | 248/56 |
| 3,871,145 | A | | 3/1975 | Hatmaker | |
| 4,437,687 | A | * | 3/1984 | Wilson | 285/42 |
| 4,453,562 | A | * | 6/1984 | Palkovics | 137/382 |
| 4,622,887 | A | * | 11/1986 | Peterson | 454/3 |
| 4,897,974 | A | * | 2/1990 | Lane | 52/199 |
| 5,018,748 | A | * | 5/1991 | Schalle | 277/641 |
| 5,117,597 | A | * | 6/1992 | Feller | 52/199 |
| 5,176,408 | A | * | 1/1993 | Pedersen | 285/42 |
| 5,226,263 | A | * | 7/1993 | Merrin et al. | 52/58 |
| 5,536,048 | A | | 7/1996 | Orr | |
| 5,588,267 | A | * | 12/1996 | Rodriguez et al. | 52/219 |
| 5,832,675 | A | * | 11/1998 | Zuares | 52/60 |
| 5,946,863 | A | * | 9/1999 | Bullard | 52/58 |
| 5,970,667 | A | * | 10/1999 | Thaler | 52/219 |
| 6,161,590 | A | * | 12/2000 | Wulff | 138/110 |
| 6,185,885 | B1 | * | 2/2001 | Thaler | 52/219 |
| 6,591,561 | B1 | | 7/2003 | Evensen | |
| 6,640,503 | B1 | * | 11/2003 | Evensen et al. | 52/60 |
| 6,852,023 | B2 | | 2/2005 | Hediger et al. | |
| 7,526,895 | B2 | | 5/2009 | Edgar et al. | |
| 2003/0233797 | A1 | * | 12/2003 | Anderson | 52/218 |
| 2004/0255523 | A1 | * | 12/2004 | Bibaud et al. | 52/58 |
| 2005/0150176 | A1 | | 7/2005 | Erekson | |
| 2005/0204648 | A1 | * | 9/2005 | Bibaud et al. | 52/58 |
| 2006/0130411 | A1 | * | 6/2006 | Edgar et al. | 52/58 |
| 2007/0094939 | A1 | | 5/2007 | Bachman | |
| 2007/0221195 | A1 | * | 9/2007 | Bibaud et al. | 126/80 |

* cited by examiner

*Primary Examiner* — Eileen D Lillis
*Assistant Examiner* — Mark Wendell
(74) *Attorney, Agent, or Firm* — Oblon, Spivak, McClelland, Maier & Neustadt, L.L.P.

(57) ABSTRACT

A storm collar includes a shield, an upper anchoring collar, support arms, and a lower anchoring collar. The upper anchoring collar secures the shield to an exhaust stack. The support arms are attached to the underside of the shield and the lower anchoring collar. Gaskets are placed between the joints of the storm collar pieces and between the exhaust stack for a tight fit. The angle of the support arms and the shield provide a compression fit based on the load supported by the shield. The storm collar protects the flashing and joints around an exhaust stack from damage caused by moisture.

21 Claims, 3 Drawing Sheets

STORM COLLAR APPARATUS AND METHOD OF INSTALLATION

BACKGROUND

1. Field

The embodiments discussed herein relate to a storm collar apparatus. More specifically, a storm collar that shields the base of exhaust stacks located on building roofs and reduces water and ice formation on and around the exhaust stacks, is described.

2. Description of the Related Art

Storm collars are used to divert moisture from entering a building or other structure through the flashing and joints found at exhaust stacks, typically on a roof. If moisture gets into the joints of or under the exhaust stack or flashing, the moisture can penetrate deeper into the building and cause damage. For example, moisture can damage the building structure or the electronics, and it can create a hazard on walkways within the structure after leaking in through the roof. Additionally, when moisture gets into the flashing or joints, it can freeze and expand, which creates stress on the structure from the expansion pressure and can cause additional physical damage to the structure. This damage then requires additional maintenance and repair costs.

A wide variety of shields or covers are commonly used to protect the flashing and exhaust stack from physical damage as discussed above. The integrity of the seal between the roof surrounding the exhaust stack and the external atmosphere is dependent in part on the protection afforded by the storm collar.

One example of a related storm collar is configured such that the bottom perimeter of the shield is flush with the roof surface, and the top perimeter of the shield abuts the outer circumference of the exhaust stack. Although this particular design may shield the base of the exhaust stack from direct exposure to moisture, moisture may still penetrate, either around the bottom perimeter of the shield or between the stack and the top perimeter of the shield for example, and seep into the flashing.

In some circumstances, a storm collar may be installed after an exhaust stack is already in use. Because of the chemicals that are often exhausted through such stacks, installation of a storm collar after the stack is in use can be dangerous. Beyond the basic potential human exposure to the chemicals, there is also the potential for a chemical reaction occurring depending on how the storm collar is installed. Installation of some storm collars requires construction involving "hot work," which includes high temperatures and/or fire, such as in welding. The use of "hot work" during installation raises the risk of a negative chemical reaction occurring due to the heat or fire involved. Such a reaction could cause physical damage or injury to the building and exhaust stack structure or to those performing the installation.

Another problem with other related storm collars is that installation may require breaching the exterior perimeter of an exhaust stack or the roof in order to secure a component of the storm collar directly to the stack. For example, screws, nails, or other forms of attaching materials may puncture the stack or roof to secure a portion of the storm collar. These forms of attachment cause structural damage to the exhaust stack and/or the roof, thereby increasing cost of maintenance and further increasing the chance for moisture to enter the structure through the puncture.

Other related storm collars attempt to solve the problem of dangerous construction practices by using a single-piece collar that slides over the top of the stack and is then glued in place or secured to the roof or stack. However, due to the wide variety of sizes and heights of exhaust stacks, it may be impossible, or at least very inconvenient, to try to slide a collar over the top of a stack, and further the means of securing such a collar to the stack may not be compatible with the surface of the exhaust stack. For example, some storm collars use glue to adhere the storm collar to the exhaust stack, but as mentioned above, the potential chemicals that are exhausted could interact negatively with the glue and cause additional problems.

SUMMARY

According to an embodiment of the present invention, there is provided a storm collar that includes a shield and an upper anchoring collar removably disposed on a top portion of the shield. The storm collar is supported by support arms that have an upper end removably attached to an underside of the shield and a lower end that extends inward toward a central axis of the shield. Additionally, a lower anchoring collar is attached to the lower ends of the support arms.

According to another embodiment of the present invention, there is provided a shield and a means for securing a top portion of the shield to an exhaust stack. Additionally, a means for supporting the shield is provided, such that a bottom perimeter of the shield is disposed outwardly lower than a top perimeter of the shield. Also included is a means for decreasing liquid permeability between shield joints and between the shield and the stack.

A method of installing the storm collar includes: adjoining one or more shield sections around an exhaust stack; inserting a gasket between joints of adjacent shield sections; securing an upper anchoring collar on a top portion of the shield sections; connecting a plurality of support arms to the shield sections, such that an upper end of each support arm is attached to an underside of the shield and a lower end of each support arm extends inward toward a center of the shield; and securing a lower anchoring collar to the lower ends of the plurality of support arms, such that the lower anchoring collar is affixed on the exhaust stack below the shield.

Another embodiment of the storm collar includes an exhaust stack; a shield surrounding the exhaust stack; an upper anchoring collar removably disposed on a top portion of the shield; a plurality of support arms, an upper end of each support arm being removably attached to an underside of the shield and a lower end of each support arm extending inward toward a central axis of the shield; a lower anchoring collar removably attached to the lower ends of the plurality of support arms; and a plurality of gaskets disposed between shield joints.

It is to be understood that both the foregoing general description and the following detailed description are examples and explanatory and are not restrictive of the invention, as claimed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings. However, the accompanying drawings and their exemplary depictions do not in any way limit the scope of the inventions embraced by this specification. The scope of the inventions embraced by the specification and drawings are defined by the words of the accompanying claims.

DETAILED DESCRIPTION

In the following, the present advancement will be discussed by describing an exemplary embodiment with reference to the accompanying drawings. However, those skilled in the art will realize other applications and modifications within the scope of the disclosure as defined in the enclosed claims.

As recognized by the present inventor, a need exists for a storm collar that can be installed on preexisting exhaust stacks without requiring dangerous or destructive construction methods. For example, a storm collar is needed that does not involve high temperatures, as in hot work, or physical damage to the exhaust stack or building during installation. Additionally, the need exists for a storm collar that can be conveniently assembled, without having to lift the collar up and over the top of the exhaust stack or secure it with potentially incompatible materials, which will require constant maintenance.

Figure 1:
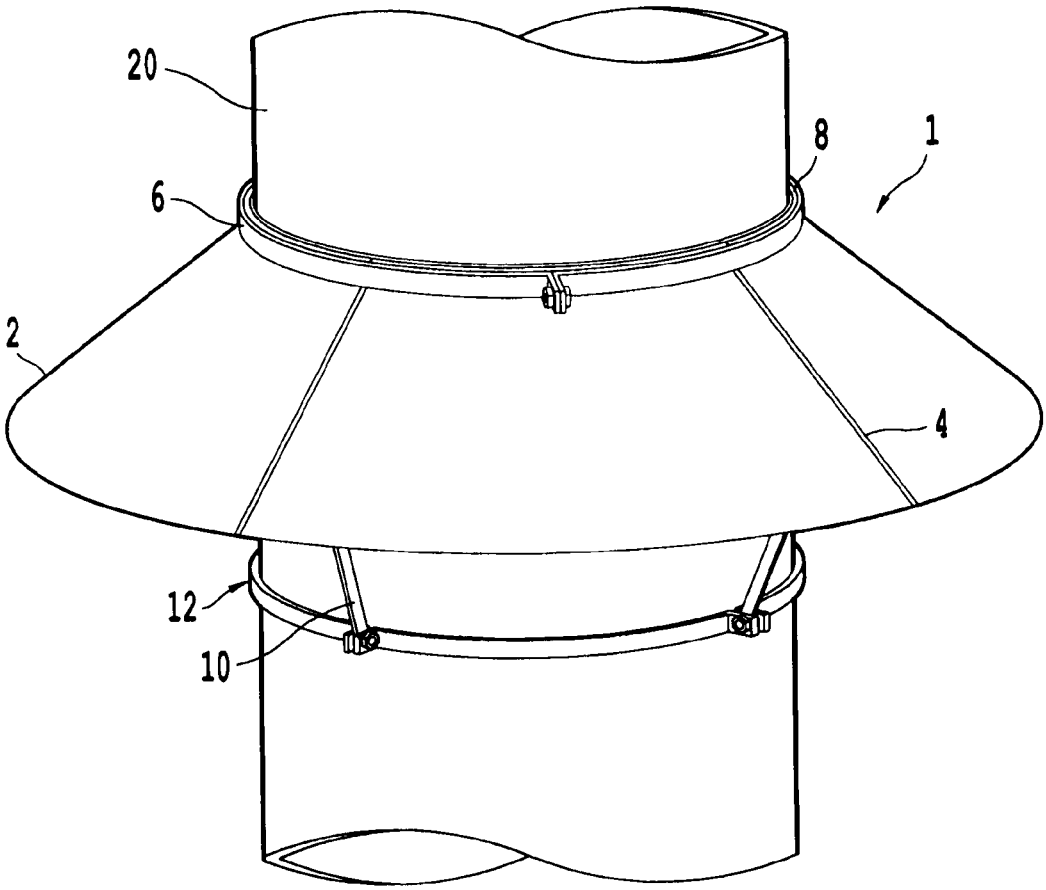
FIG. 1 is a perspective view drawing of an assembled storm collar according to an exemplary embodiment of the present disclosure.

FIG. 1 is a perspective view of an assembled storm collar 1 attached to an exhaust stack 20. In FIG. 1, the shield 2 is supported by support arms 10 and lower anchoring collar 12. An upper anchoring collar 6 secures the top of the shield 2 to the exhaust stack 20, by compressing an upper gasket 8 between the exhaust stack 20 and the shield 2 to make a tight compression fit.

Figures 2, 3:
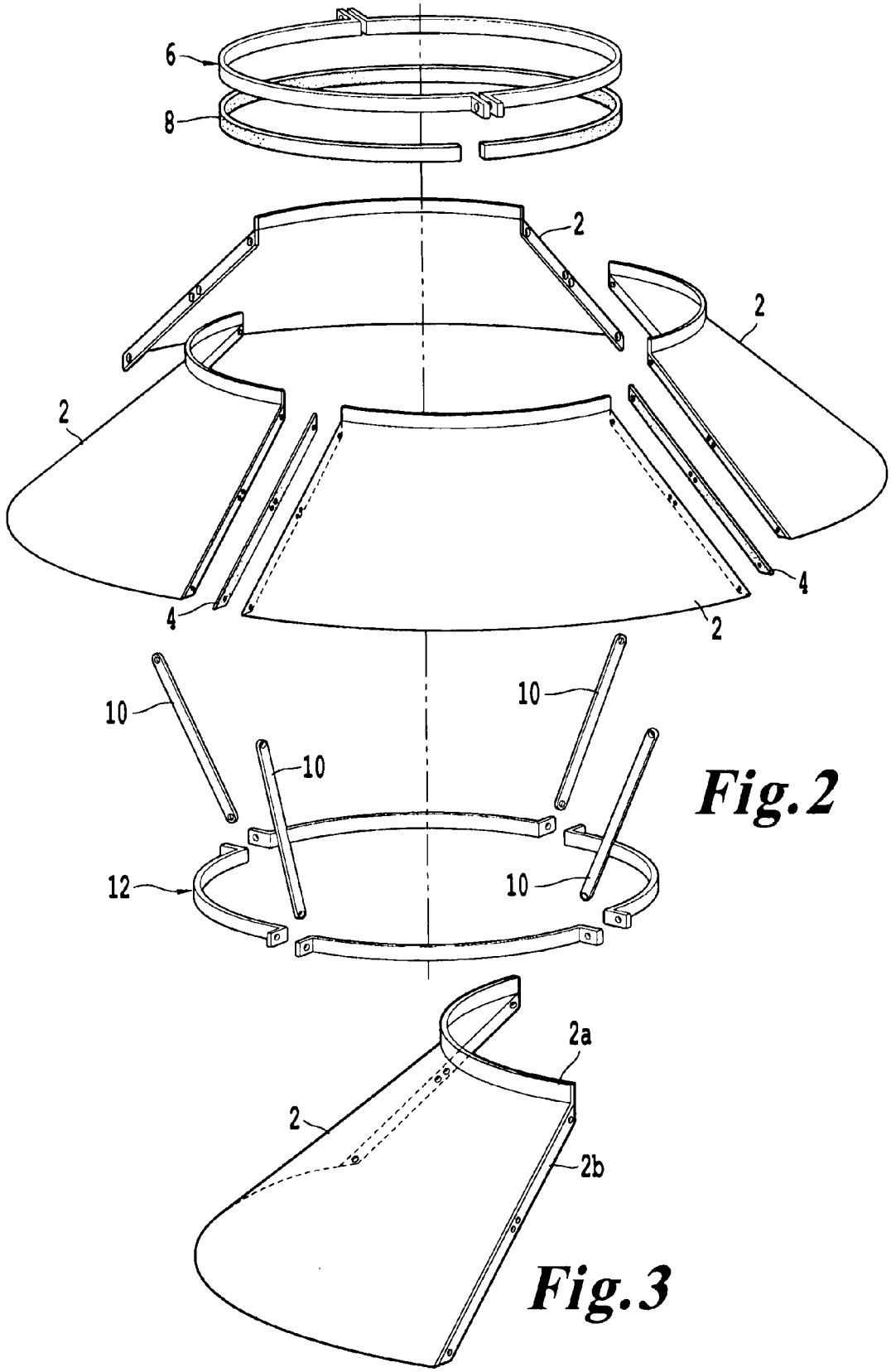
FIG. 2 is an exploded perspective view drawing of a storm collar according to an exemplary embodiment of the present disclosure.
FIG. 3 is a perspective view drawing of a shield piece of a storm collar according to an exemplary embodiment of the present disclosure.

FIG. 2 is an exploded perspective view of the storm collar 1 to show the individual components more clearly. In the particular embodiment of the invention shown in FIG. 2, several of the components are divided into four pieces each. One skilled in the art will appreciate that a number of sections greater or smaller may be used to achieve the same objectives. The storm collar 1 is designed with sectional components of substantially similar shape and size so that the component pieces are interchangeable with other component pieces of the same type, which simplifies the assembly. In other words, so long as the correct quantity of each component is present, the individual pieces can be assembled in any order because each section piece is substantially similar.

As shown in FIG. 2, the shield 2 is divided into multiple sections, which are joined at a shield side flange 2*b* to make a continuous upper surface. Between each shield 2 section, a joint gasket 4 is inserted to decrease moisture permeability at the joint and to direct any moisture to run off the bottom perimeter of the shield 2, instead of accumulating at the joint. Note that only two of four joint gaskets 4 are shown in FIG. 2, but it is implied that a joint gasket 4 is installed between each shield 2 section. These joint gaskets 4 can be made of a variety of materials, including polychloroprene, also known as Neoprene. Polychloroprene is desirable due to its elastic and water-repelling properties, thus making polychloroprene ideal for a compression fit between potentially inconsistent surfaces on the shield 2 caused by the manufacturing process.

Figure 4:
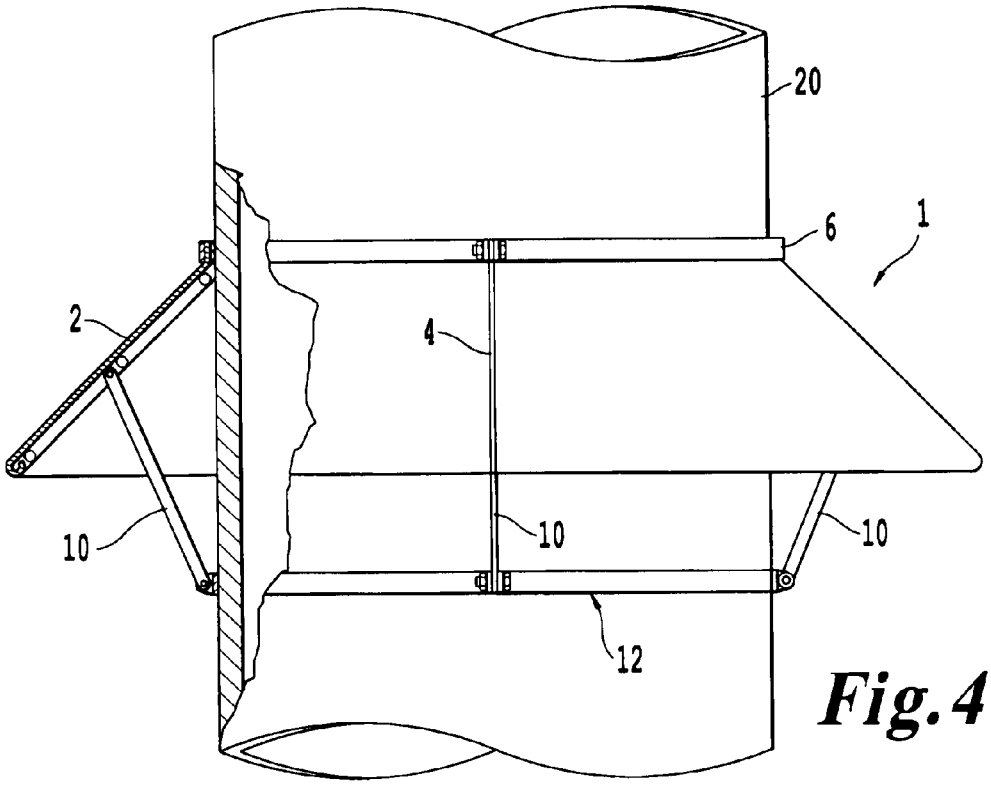
FIG. 4 is a partial cross-sectional side view drawing of an assembled storm collar according to an exemplary embodiment of the present disclosure.
Figure 6:
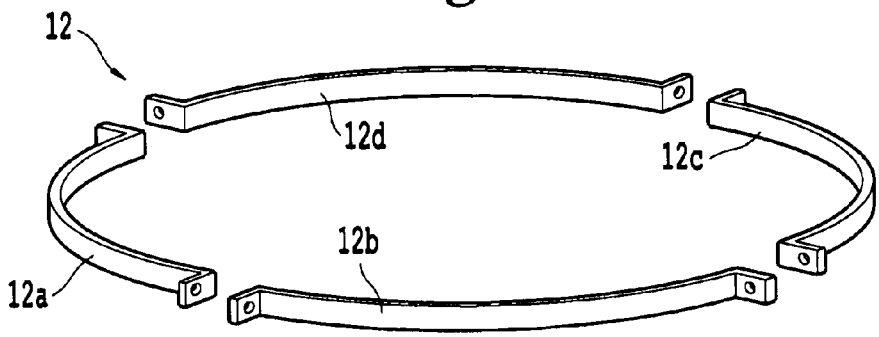
FIG. 6 is a perspective view drawing of a lower anchoring collar of a storm collar according to an exemplary embodiment of the present disclosure.

FIGS. 1, 3, and 4 show that the assembled shield 2 sections extend outward from the exhaust stack. The shield 2 sections are supported by an upper end of the support arms 10, which is attached to an interior portion of a side flange 2*b*. A lower end of the support arms 10 extends from the side flange 2*b* to the joints of a lower anchoring collar 12. One skilled in the art will appreciate that the support arms 10 could be attached at other locations underneath the shield, such as if another means for connection were positioned away from the side flanges 2*b*. As shown in FIG. 4, the upper end of each support arm 10 connects on the interior portion of the side flange 2*b*, so that the exterior portion of the side flanges 2*b* is flush with the joint gaskets 4, thereby creating a tight seal between shield 2 sections. The lower anchoring collar 12 is divided into multiple parts (12*a*, 12, 12*c*, and 12*d*, as shown in FIG. 6) for the convenience of securing the support arms 10.

In order to prevent moisture from leaking down the stack through the top perimeter of the assembled storm collar 1, a tight seal is formed between the exterior surface of the exhaust stack and the top perimeter of the shield 2. This tight seal is accomplished by placing an upper gasket 8 around the exhaust stack at a predetermined height. The height of the upper gasket 8 on the exhaust stack, and the top perimeter of the storm collar 1 will generally correlate to the location where condensation begins to form on the exterior of the stack. Although the upper gasket 8 is shown in FIG. 2 as a single, continuous piece, it is understood that the upper gasket 8 could be divided into multiple sections as well. Note, however, that by using a single, continuous upper gasket 8, there are fewer joints exposed to moisture penetration. As with the joint gaskets 4, the upper gasket 8 may be formed from a variety of materials, ideally from polychloroprene.

Figure 5:
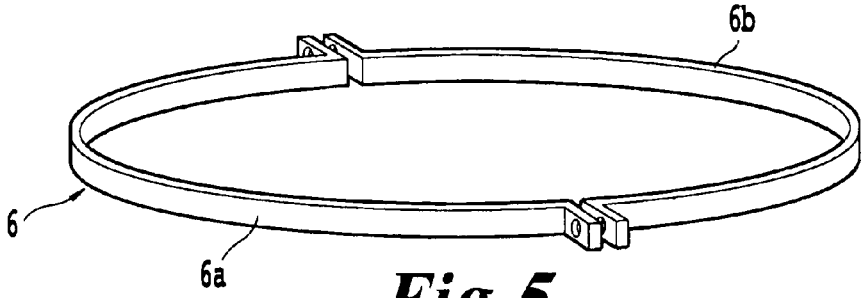
FIG. 5 is a perspective view drawing of an upper anchoring collar of a storm collar according to an exemplary embodiment of the present disclosure.

After placing the location for upper gasket 8, the upper flange 2*a* of each shield 2 section is placed against the upper gasket 8. Next, the upper anchoring collar 6 is secured around the outside of the upper flanges 2*a* of the connected shield 2 sections, thereby making a compression seal by compressing the upper flanges 2*a* onto the upper gasket 8, which is compressed against the exhaust stack. As depicted in FIGS. 2 and 5, the upper anchoring collar 6 is divided into two pieces (6*a* and 6*b*), but could be divided into more if desired. It is also possible, depending on the material used and the size of the exhaust stack, that the upper anchoring collar could be a single piece.

In another exemplary embodiment of the present invention, the bottom perimeter of the shield 2 has a rolled edge, as is seen in FIG. 4. The technique of rolling the edge is used to strengthen the bottom perimeter of the shield 2. Additionally, a rolled edge is a safety feature, in that it replaces a potentially sharp bottom perimeter edge on the shield 2.

In yet another exemplary embodiment of the present invention, the upper surface of the shield 2 includes a black or dark-colored coating. The coating can be a paint or a non-stick coating, such as is made by Wearlon®. The black or dark-colored coating acts a passive-heating element to melt ice or snow using the rays of the sun. As such, no electric components are necessary to melt the ice and/or snow that accumulates on the shield and which could damage the exhaust stack flashing.

As mentioned previously, several components of the storm collar 1 are sectionalized. Several benefits are obtained by dividing the components into smaller sections. One primary benefit is the ease of assembly and transportation. Since the parts are in sections, there is no need to wrap a shield around the exhaust stack, nor, in the case of a unitary shield, is there a need to elevate the shield high enough to slide over the top of an exhaust stack. Instead, the storm collar 1 can be brought to the roof in smaller pieces and assembled quickly and simply, with minimal tools required.

Another benefit regards the ease of installation on preexisting exhaust stacks. One or more embodiments of storm collar 1 do not require welding, dangerous construction, or even the need to screw or bolt the storm collar 1 to the exhaust stack or roof. The joints are all secured through compression fits between the other parts of the storm collar 1 itself and the exterior surface of the exhaust stack. Therefore, the storm collar 1 can be installed on preexisting exhaust stacks without concern for potential chemical reactions, which may be induced by related assembly methods that include hot welding for example. The storm collar 1 can also be installed without causing structural damage the exhaust stack or the roof.

Other aspects of the storm collar structure will vary depending on the climate in which the storm collar is used, the size of the exhaust stack, and the exhaust matter exiting the stack. For example, the shield and other components may be made of steel having varying gages, or a weaker material such as aluminum. The choice of material will depend on the expected load that the shield might bear. In particular, if heavy snow or ice is expected to form on the shield, the components should be made of a stronger material and/or a smaller gage of material to support the heavier load. In addition, the quantity of support arms could vary depending on the number of shield sections, preferably maintaining at least one support arm for each shield section. Further, the inner diameters of the top perimeter of the shield, the anchoring collars, and the upper gasket will vary depending on the size of the stack. For exhaust stacks having a perimeter shape other than circular, the outer perimeter of the shield may vary in shape as well, such as being pyramidal, for example.

The pitch of the slope on the shield, and the overall horizontal distance to which the shield extends away from the exhaust stack, may also vary greatly depending on the size of the flashing around the stack needing protection and the height of the storm collar above the base of the exhaust stack. A preferred embodiment of the present invention implements a shield with approximately a 45 degree slope, which reinforces the compression fit on the lower anchoring collar when a load is placed on the shield from snow or ice.

As recognized by the present inventor, the storm collar as described herein is easy to assemble, which makes it more suitable for installing a storm collar on preexisting exhaust stacks. Further, the compression fit of the storm collar structure displaces moisture from the exhaust stack and flashing very effectively. Therefore, the storm collar helps prevent damage to the building and reduces needless maintenance costs.

Obviously, numerous modifications and variations of the present invention are possible in light of the above teachings. It is therefore to be understood that within the scope of the appended claims, the invention may be practiced otherwise than as specifically described herein.

The invention claimed is:

1. A storm collar, comprising:

a shield;

an upper anchoring collar removably disposed on a top portion of the shield;

a plurality of support arms, an upper end of each support arm being removably attached to an underside of the shield and a longitudinal axis of each support arm extending inward toward a central axis of the shield; and a lower anchoring collar removably attached to lower ends of the plurality of support arms.

2. The storm collar according to claim 1, wherein the shield is divided into a plurality of shield sections, and wherein a gasket is disposed between shield section joints.

3. The storm collar according to claim 2, wherein each shield section is supported by at least one support arm.

4. The storm collar according to claim 2, wherein each shield section includes opposing side flanges, the flanges being disposed along a length of opposing side edges of each shield section, and wherein at least one of the flanges on each shield section includes a connection portion that connects to the upper end of at least one support arm.

5. The storm collar according to claim 2, wherein the gaskets comprise a polychloroprene material.

6. The storm collar according to claim 1, wherein a gasket is disposed between an upper flange of the shield and an exhaust stack, to which the storm collar is secured.

7. The storm collar according to claim 1, wherein the shield is angled in a downward direction away from the central axis of the shield approximating a 45 degree slope.

8. The storm collar according to claim 1, wherein a bottom perimeter of the shield is circular.

9. The storm collar according to claim 1, wherein a bottom perimeter of the shield is pyramidal.

10. The storm collar according to claim 1, wherein at least an upper surface of the shield has a coating, the coating being of a substantially dark color.

11. The storm collar according to claim 1, wherein an outside diameter of the shield is at least 36 inches greater than an inside diameter of the shield.

12. The storm collar according to claim 1, wherein a bottom perimeter of the shield is rolled.

13. The storm collar according to claim 1, wherein the lower anchoring collar includes a plurality of pieces, such that each piece of the lower anchoring collar has an inner surface arc radius substantially equivalent to an arc radius of an exterior surface of an exhaust stack on which the lower anchoring collar is installed, and wherein each piece of the lower anchoring collar is configured to connect to the lower end of at least one support arm.

14. A storm collar, comprising:

a shield;

means for securing a top portion of the shield to an exhaust stack;

means for supporting the shield, such that a bottom perimeter of the shield is disposed outwardly lower than a top perimeter of the shield, the means for supporting the shield including a plurality of support arms, each support arm having a longitudinal axis that extends inward toward a central axis of the shield; and means for decreasing liquid permeability between shield joints and between the shield and the exhaust stack.

15. The storm collar according to claim 14, wherein the means for decreasing liquid permeability includes polychloroprene gaskets.

16. A method of installing a storm collar, comprising:

adjoining one or more shield sections around an exhaust stack;

inserting a gasket between joints of adjacent shield sections;

securing an upper anchoring collar on a top portion of the shield sections;

connecting a plurality of support arms to the shield sections, such that an upper end of each support arm is attached to an underside of the shield and a longitudinal axis of each support arm extends inward toward a center of the shield; and securing a lower anchoring collar to lower ends of the plurality of support arms, such that the lower anchoring collar is affixed on the exhaust stack below the shield.

17. A storm collar, comprising:

an exhaust stack;

a shield surrounding the exhaust stack;

an upper anchoring collar removably disposed on a top portion of the shield;

a plurality of support arms, an upper end of each support arm being removably attached to an underside of the shield and a longitudinal axis of each support arm extending inward toward a central axis of the shield;

a lower anchoring collar removably attached to lower ends of the plurality of support arms; and a plurality of gaskets disposed between shield joints.

18. The storm collar according to claim 17, wherein the gaskets are made of a polychloroprene material.

19. The storm collar according to claim 17, wherein the shield is angled in a downward direction away from the central axis of the shield approximating a 45 degree slope.

20. The storm collar according to claim 17, wherein at least an upper surface of the shield has a coating, the coating being of a substantially dark color.

21. The storm collar according to claim 20, wherein the coating is a non-stick coating.

* * * * *